US006354639B1

(12) United States Patent
Minter et al.

(10) Patent No.: US 6,354,639 B1
(45) Date of Patent: Mar. 12, 2002

(54) LOCK HANDLE ASSEMBLY FOR CASEMENT WINDOWS

(75) Inventors: Peter J. Minter; John A. Chiaia, both of Branford, CT (US)

(73) Assignee: Roto Frank of America, Inc., Essex, CT (US)

( * ) Notice: Subject to any disclaimer, the term of this patent is extended or adjusted under 35 U.S.C. 154(b) by 0 days.

(21) Appl. No.: 09/494,272

(22) Filed: Jan. 31, 2000

(51) Int. Cl.[7] ..... E05C 1/06

(52) U.S. Cl. ..... 292/142; 292/DIG. 20; 292/DIG. 47

(58) Field of Search ..... 292/39, 263, 300, 292/336.3, 142, 160, DIG. 20, DIG. 47, 302, 36; 49/249, 342; 74/98, 460

(56) References Cited

U.S. PATENT DOCUMENTS

| | | | | | |
|---|---|---|---|---|---|
| 2,576,536 | A | * | 11/1951 | Reynaud | 74/98 |
| 3,032,330 | A | * | 5/1962 | Stavenau | 49/249 |
| 4,059,298 | A | | 11/1977 | Van Klompenburg | 292/199 |
| 4,429,910 | A | | 2/1984 | Anderson | 292/199 |
| 4,621,847 | A | | 11/1986 | Paulson et al. | 292/DIG. 47 |
| 4,991,886 | A | | 2/1991 | Nolte et al. | |
| 5,118,145 | A | | 6/1992 | Tucker | 292/158 |
| 5,318,333 | A | | 6/1994 | Dreifert | 292/36 |
| 5,370,428 | A | | 12/1994 | Dreifert et al. | |
| 5,595,409 | A | * | 1/1997 | Fier et al. | 292/DIG. 46 |
| 5,697,654 | A | * | 12/1997 | MacDonald | 292/39 |
| D388,689 | S | | 1/1998 | Bauman et al. | |
| D390,445 | S | | 2/1998 | Johnson et al. | |
| 5,741,031 | A | | 4/1998 | Bauman et al. | 292/139 |
| 5,778,602 | A | | 7/1998 | Johnson et al. | 292/DIG. 47 |
| 5,839,767 | A | | 11/1998 | Piltingsrud | 292/336.3 |
| 5,907,885 | A | * | 6/1999 | Tilli et al. | 74/426 |

OTHER PUBLICATIONS

Brochure entitled: "Casement Operator and Multi Point Locking Bar for Vinyl and Aluminium Casement Windows" by Wilhelm Weidtmann GmbH & Co. KG Baubeschläge.

* cited by examiner

*Primary Examiner*—Robert J. Oberleitner
*Assistant Examiner*—Thomas J. Williams
(74) *Attorney, Agent, or Firm*—Marshall, Gerstein, & Borun.

(57) ABSTRACT

A lock handle assembly for a multi-point casement window is disclosed. The lock handle assembly includes an escutcheon for mounting to the inside surface of the frame. The escutcheon includes an elongated body which features an inner side facing away from the inside surface of the frame and an outer side that extends through the inside surface of the frame. The escutcheon further includes an elongated slot for receiving a handle through the inner side of the escutcheon. The slot comprises an upper end and a lower end defined by upper and lower walls respectively. The handle is pivotally connected to the escutcheon by a shaft having an axis that extends transversely through the slot. The shaft further connects a movable link to the handle. The shaft also passes through a fixed gear which is secured to the escutcheon. The fixed gear includes an arcuate gear. The movable link includes a proximal end pivotally connected to the shaft in a distal end pivotally connected to a drive gear link. The drive gear link includes a distal end pivotally connected to a movable link and a proximate end including an arcuate gear enmeshed with the arcuate gear of the fixed gear. The distal end of the drive gear link also is pivotally connected to the connecting link at a connecting axis. This design enables the handle to undergo a relatively short range rotation ranging from about 100° to about 140° while moving the connecting axis through an arcuate path defined by an angle ranging from about 140° to about 180°. The handle and escutcheon present a relatively low profile on the inside surface of the sash.

20 Claims, 5 Drawing Sheets

LOCK HANDLE ASSEMBLY FOR CASEMENT WINDOWS

FIELD OF THE INVENTION

The present invention relates generally to locking mechanisms for casement windows. More specifically, the present invention relates to an improved lock handle assembly or actuator assembly for a casement window lock. Still more specifically, the present invention relates to an improved lock handle assembly or actuator assembly for installation on vinyl casement windows.

BACKGROUND OF THE INVENTION

Casement windows are known. In the past, the locking of a casement window sash to a window frame has been problematic because casement window sashes have a tendency to warp with age and therefore it can be difficult to hold an entire side edge of a sash against a frame for locking purposes. Further, casement window operators typically apply the closing force to only one end of the casement window sash, e.g. the bottom end, and therefore there is a tendency for one end of the sash to engage the frame before the opposing end of the sash. As a result, the side edge of the sash that is to be locked against the frame does not engage the frame all at once thereby making the sash difficult to lock.

To overcome these problems, tie bars have been employed along the edge of the frame to lock the sash against the frame. The tie bars typically include a plurality of rollers mounted on the tie bar that engage ramped keepers spaced along the edge of the window sash. To overcome the warping problem discussed above, the rollers and keepers are appropriately spaced so that the rollers engage the keepers in a sequential manner, starting from the bottom of the sash and ending with the top of the sash. As a result, the bottom of the sash is locked first and the sequential interaction of the middle and top rollers with the middle and top keepers respectively results in the middle and top portions of the sash being pulled against the frame and locked shut.

However, due to the success and wide acceptance of such sequential locking mechanisms, these locking mechanisms are used in a variety of different windows having window frames and window sashes with a variety of dimensions and configurations. As a result, the spacing between the handle or actuator from the tie bar can vary depending upon the manufacturer and window style. Some locks are usable only with certain styles of windows and other window styles require that locks be specifically manufactured for that style. As a result, manufacturing costs can be quite high and the wide variety of locks that are required requires builders to maintain undesirably large inventories of such locks.

A further problem associated with casement window locks employing tie bars is the relative ease in which such locks can be picked. Specifically, in many prior art casement window locks, an intruder can pick the lock or force the lock open by sticking a sharp object between the sash and the frame, engaging the tie bar and pushing downward. Many casement window locks will easily open up upon the application of downward pressure on the tie bar because the handles for casement window locks are not held or retained in place and are typically free to move from the locked to the open position. Further, any attempt to employ a retainer or a latch to hold the handle in the closed or locked position would adversely affect the aesthetics of the handle and escutcheon assembly.

Still further, aesthetic demands have required the handle and escutcheon to have a relatively low profile on the inside surface of the frame. Escutcheons that protrude outwardly from the inside surface of the frame more than ¾" are not preferred by consumers and interior designers because they present a prominent appearance on the inside surface of the frame. Instead, consumers and interior designers prefer a low profile escutcheon/handle combination that attracts little notice.

However, while aesthetics demand a low profile, functionality often demands that the handle be able to rotate 180° in order to impart a sufficient amount of linear travel to the tie bar. As a result, currently available lock handle assemblies are not able to provide a combination of a low profile for the handle and escutcheon in combination with a 180° rotation of the handle.

Therefore, there is a need for an improved lock handle assembly for casement windows that can be utilized on a variety of window designs, that is relatively pick proof or "jimmy" proof and further that provides a combination of a low profile for the escutcheon and handle with a sufficient amount of lever throw resulting in a sufficient amount of linear travel for the tie bar.

SUMMARY OF THE INVENTION

The present invention provides a lock handle assembly that satisfies all of the aforenoted needs. Specifically, the lock handle assembly of the present invention is readily adaptable to a wide variety of window sizes and styles due to its use of a connecting link between the tie bar and the lock handle mechanism. Further, the lock handle assembly of the present invention includes a drive gear link which provides an "over center" condition relative to the central point of rotation which makes the lock handle assembly of the present invention especially difficult to pick or jimmy. Still further, the lock handle assembly of the present invention includes an escutcheon that has a low profile on the inside surface of the window frame but still permits the handle to rotate through an arc sufficiently large enough to enable the axis where the connecting link is pivotally connected to the drive gear link to rotate through an arc sufficiently large enough to impart a linear travel to the tie bar in excess of 1.50".

Specifically, in an embodiment, the present invention provides a lock handle assembly for mounting to a multipoint casement window frame having an inside surface. The lock handle assembly comprises an escutcheon for mounting to the inside surface of the frame. The escutcheon comprises an elongated body comprising an inner side facing away from the inside surface of the frame and an outer side that extends through the inside surface of the frame. The escutcheon further comprises an elongated slot for receiving a handle through the inner side of the escutcheon. The slot comprises an upper end and a lower end defined by upper and lower walls respectively. The escutcheon further comprises an exterior surface. The handle is pivotally connected to the escutcheon by a shaft having an axis that extends transversely through the slot. The shaft further connects a movable link to the handle. The shaft also passes through a fixed gear which is secured to the escutcheon. The fixed gear plate comprises an arcuate gear plate. The movable link comprises a proximal end pivotally connected to the shaft and a distal end pivotally connected to a drive gear link. The drive gear link comprises a distal end pivotally connected to the movable link and a proximate end that comprises an arcuate gear plate in mesh with the arcuate gear plate of the fixed gear plate. The distal end of the drive gear link also is pivotally connected to a connecting link at a connecting axis.

The upper and lower walls and axis of the shaft define a range of rotation for the handle ranging from about 100° to about 140°. The connecting axis rotates through an arcuate path defined by an angle ranging from greater than 140° to less than 180° as the handle is rotated from engagement with the upper wall to engagement with the lower wall.

In an embodiment, the fixed gear is attached to the exterior surface of the escutcheon.

In an embodiment, the fixed gear is disposed between the movable link and the exterior surface of the escutcheon.

In an embodiment, the range of rotation for the handle ranges from about 110° to about 130°.

In an embodiment, the range of rotation for the handle is about 120°.

In an embodiment, the angle defining the arcuate path through which the connecting axis rotates ranges from about 150° to about 170°.

In an embodiment, the angle defining the arcuate path through which the connecting axis rotates is about 160°.

In an embodiment, the arcuate gear of the fixed gear extends arcuately around the shaft and is directed towards the outer side of the escutcheon.

In an embodiment, the arcuate gear of the drive gear link is directed towards the inner side of the escutcheon.

In an embodiment, the shaft passes through the outer side of the escutcheon.

In an embodiment, the shaft is disposed exterior to the inside surface of the frame.

In an embodiment, the connecting axis moves from a first point where the handle engages the upper wall to a second point where the handle engages the lower wall, the first and second points being spaced apart by a distance that is at least 1.50".

In an embodiment, the connecting axis moves from a first point where the handle engages the upper wall to a second point where the handle engages the lower wall, the first and second points being spaced apart by a distance that is about 1.89" or greater than 1.89".

In an embodiment, the distal end of the drive gear link is curved and the movable link is connected to the distal end of the drive gear link at a point offset from the connecting axis.

In an embodiment, the upper and lower walls extend towards each other as they extend from the inner side towards the outer side of the escutcheon.

As noted above, the use of a connecting link which connects the distal end of the drive gear link to the tie bar enables the lock handle assembly of the present invention to fit a wide variety of window sash styles and sizes.

Further, the drive gear link of the present invention provides an over center condition which makes the lock handle assembly pick or jimmy resistant. Specifically, the distal end of the drive gear link is connected to both a connecting link and the distal end of the movable link which is connected to the handle and which translates movement of the handle to both the drive gear link and connecting link. However, when the handle is in the closed position and an intruder attempts to pick or jimmy the lock by exerting a downward force on the tie bar or the connecting link, the downward force causes the distal end of the drive gear link to pivot towards the inner side of the escutcheon and the proximate end of the drive gear link to rotate away from the inside surface of the window sash (or towards the exterior of the building). This rotational force of the proximate end of the drive gear link towards the exterior of the building simply jams the drive gear link into the locked or closed position. As a result, the lock handle assembly does not rotate open as the intruder intends but is simply more tightly jammed in the locked position.

Further, the lock handle assembly is able to maintain a low profile on the inside surface of the window sash while imparting a sufficient amount of linear movement to the tie bar. That is because the shaft which connects the handle to the movable link and which provides the rotational axis of the handle is located below or exterior to the inside surface of the window sash. As a result, a portion of the handle penetrates the window sash and enables the handle/escutcheon combination to maintain a relatively low profile on the inside surface of the window sash.

Still further, a 180° rotation of the handle is not required to impart the requisite linear travel to the tie bar. Specifically, a smaller rotation of the handle, ranging from about 100° to about 140°, can be utilized due to the employment of the gear mechanism which comprises the arcuate gear of the fixed gear and the arcuate gear of the proximal end of the drive gear link. Thus, the employment of the gear mechanism reduces the amount of rotation required by the handle. In short, the unique combination of features provided by the lock handle assembly of the present invention enables the lock handle assembly to maintain or exhibit a low profile on the inside surface of the window sash while providing the requisite linear travel to the connecting link and therefore the tie bar.

Other objects and advantages of the present invention will become apparent to those skilled in the art upon reviewing the following detailed description, drawings and appended claims.

BRIEF DESCRIPTION OF THE DRAWINGS

For a more complete understanding of the present invention, reference should now be made to the embodiments illustrated in greater detail in the accompanying drawings and described below by way of an example of the invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
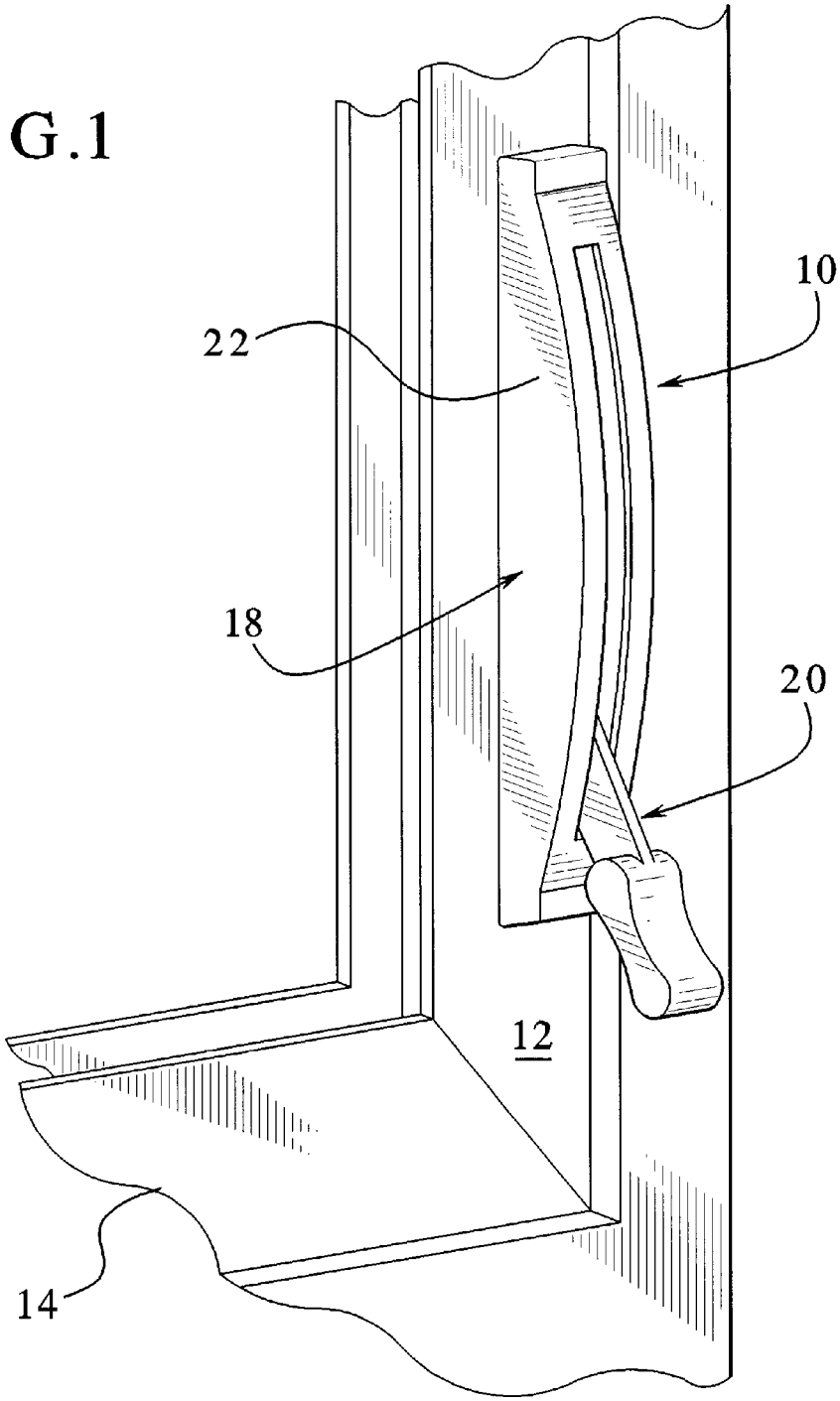
FIG. 1 is a partial perspective view of a lock handle assembly made in accordance with the present invention as installed on a casement window sash which is in the closed position and the lock handle assembly is in the locked position.

Turning first to FIG. 1, a lock handle assembly 10 is shown installed on an inside surface 12 of a casement window frame 14. The lock handle assembly 10 includes an escutcheon 18 and a handle 20, both of which are only partially shown in FIG. 1. The handle 20 is in the locked or down position.

Figure 2:
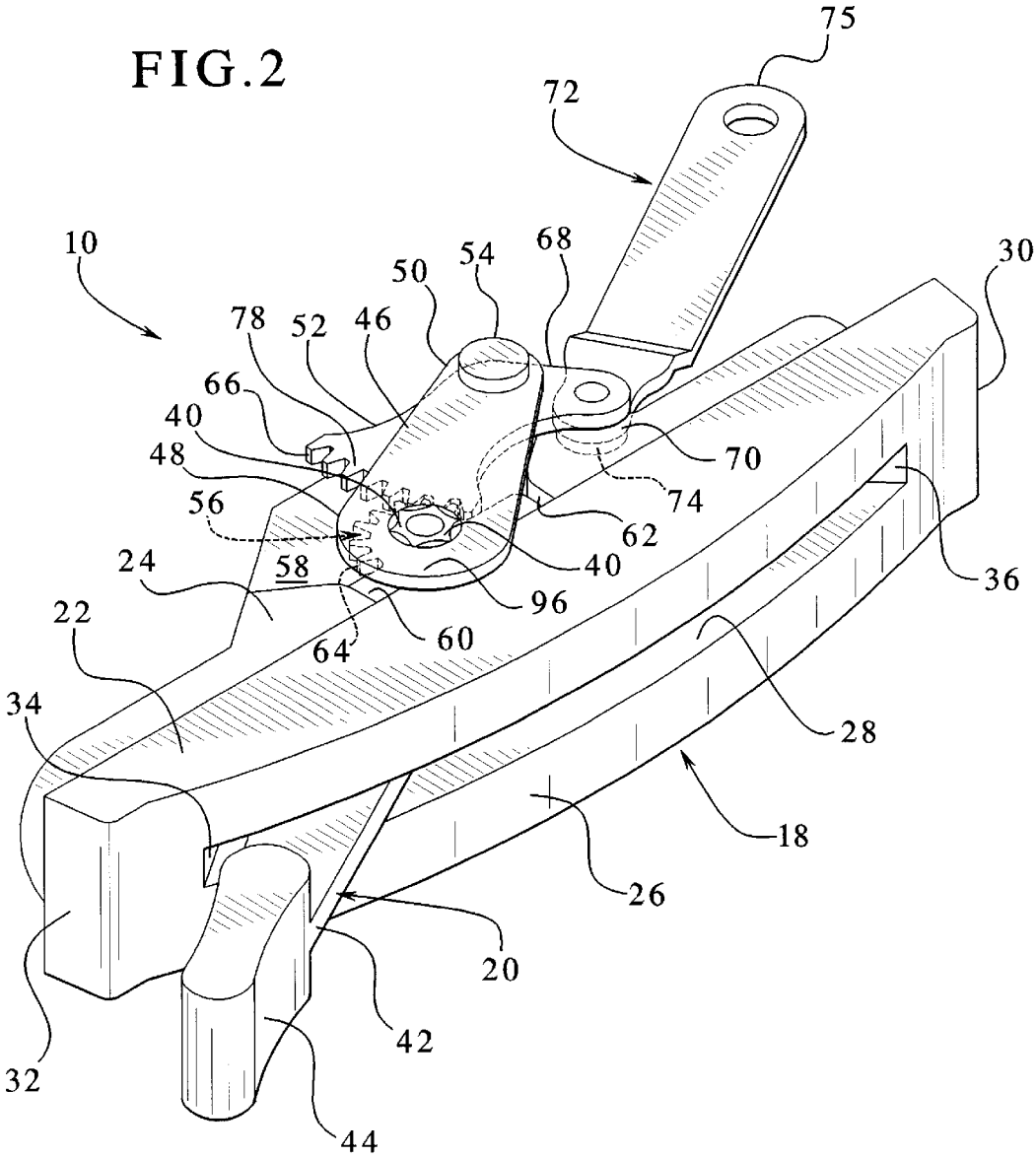
FIG. 2 is a perspective view of a lock handle assembly made in accordance with the present invention.

Turning to FIG. 2, the lock handle assembly 10 of the present invention is shown in greater detail. Specifically, the escutcheon 18 includes an inner side 22 which is disposed inside the window sash 14 as shown in FIG. 1 and an outer side 24 which extends through a hole or aperture formed in the window frame 14. A front surface 26 of the escutcheon 18 includes an elongated slot 28 which accommodates the handle 20. The escutcheon 18 also includes a top end 30 and a bottom end 32. The bottom of the slot 28 is defined by a bottom wall 34 and the top end of the slot 28 is defined by a top wall 36, both of which are only partially shown in FIG. 2. The bottom wall 34 and top wall 36 define the range of motion for the handle 20.

Figure 3:
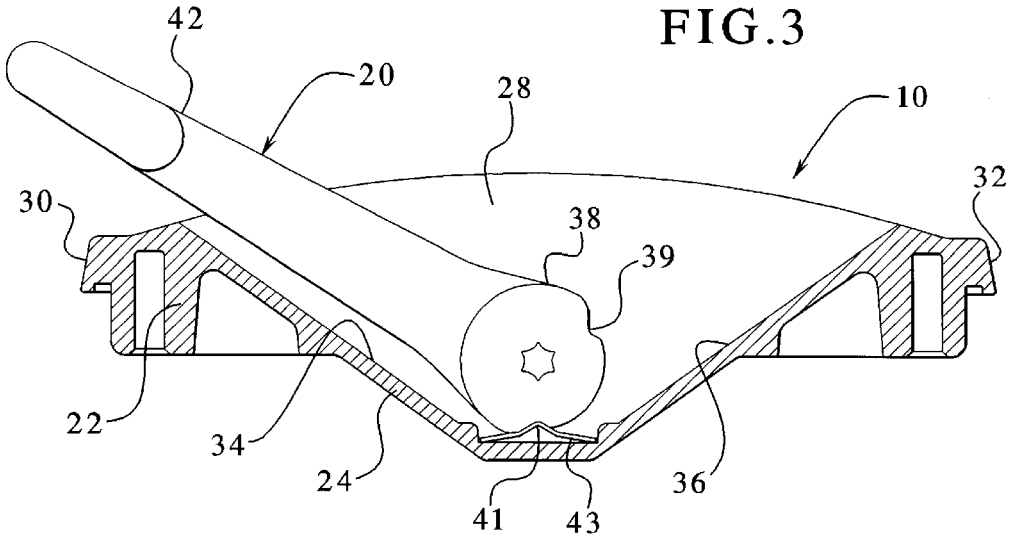
FIG. 3 is a side sectional view of the handle and escutcheon shown in FIG. 2.

As shown in FIG. 3, the bottom and top walls 34, 36 respectively extend toward each other as they extend from the inner side 22 of the escutcheon to the outer side 24 of the escutcheon. As a result, the walls 34, 36 form a V-shaped pocket for accepting the handle 20. The handle 20 includes a distal end 38 which is connected to the shaft 40 (see FIG. 2) and a proximal end 42 which includes a grip 44. As shown in FIG. 3, the distal end 38 of the handle 20 may include detents 39, 41 for engaging a spring clip 43 in the open and locked positions respectively. The snapping action that occurs when the detents 29, 41 engage the spring assures the user that the handle 20 is in the open or locked position respectively.

Figure 4:
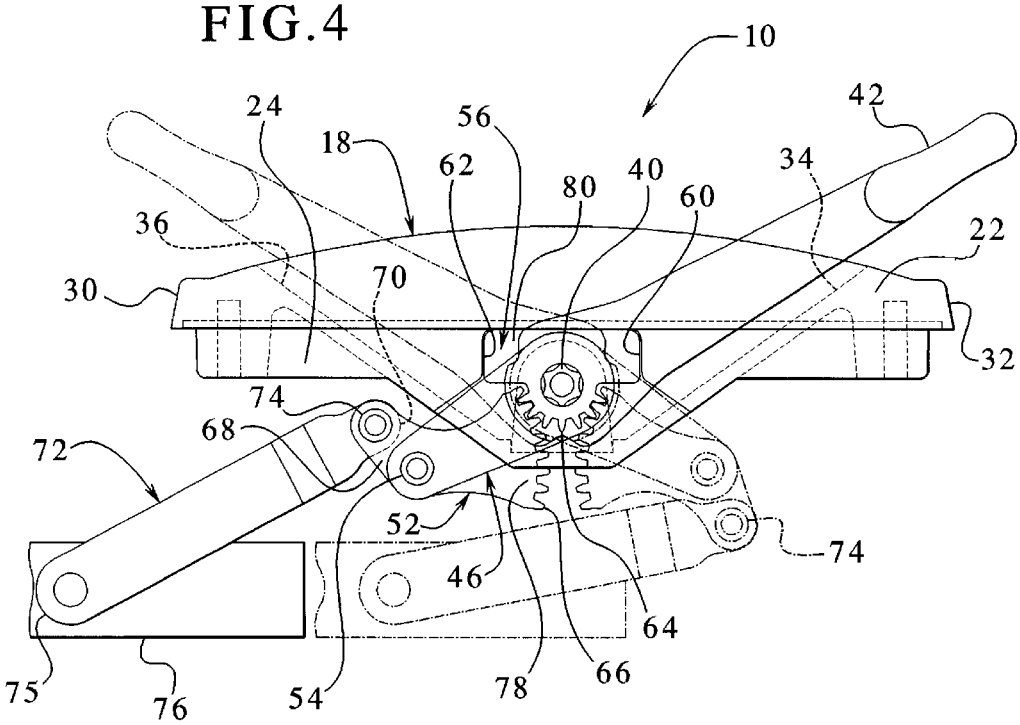
FIG. 4 is a side view of the lock handle assembly shown in FIG. 2 as connected to a tie bar and further illustrating the lock handle assembly in both the locked and unlocked positions.
Figure 5:
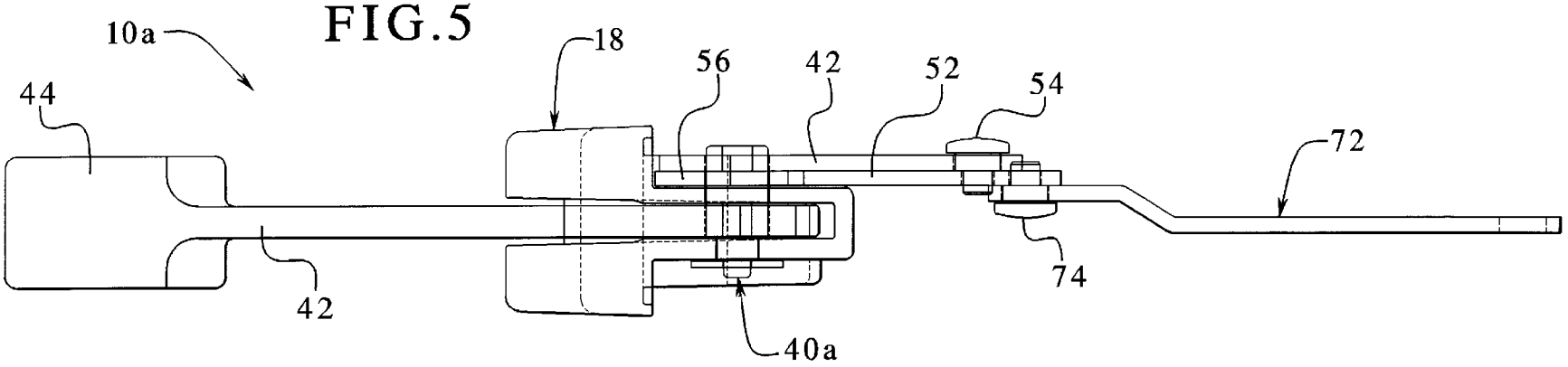
FIG. 5 is an end view of an alternative embodiment of the lock handle assembly of the present invention.

Referring to FIGS. 2, 4 and 5 collectively, it is shown that the handle 20 is connected to a movable link 46 by way of the shaft 40. The movable link 46 includes a proximal end 48 which is connected to the handle 20 by way of the shaft 40 and a distal end 50 which is connected to a drive gear link 52 by way of a rivet 54 or other suitable device intended for pivotal connection. In the embodiment illustrated, the movable link 46 overlays both the drive gear link 52 and the fixed gear 56 which is securely mounted against the exterior surface 58 of the escutcheon 18. The fixed gear 56 may also be cast as an integral part of the escutcheon 18.

In the embodiment illustrated in FIGS. 2 and 4, the fixed gear 56 is disposed between two opposing walls 60, 62. Other means for securely attaching the fixed gear 56 to the escutcheon 18 will be apparent to those skilled in the art.

Figure 6:
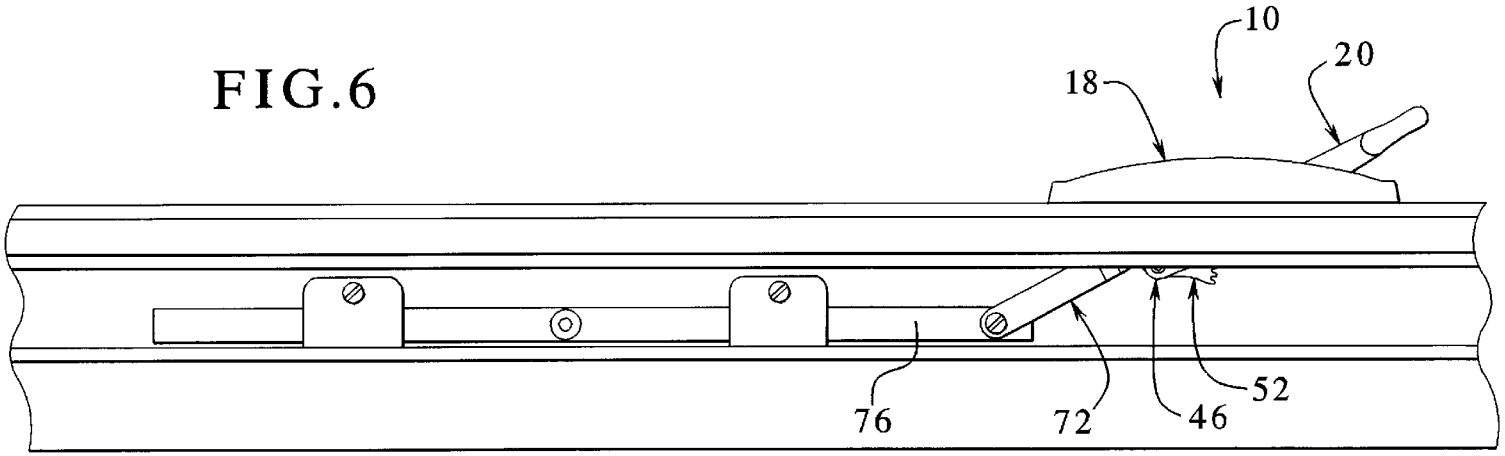
FIG. 6 is a side view of the lock handle assembly of the present invention as installed on a window sash and as connected to a tie bar.

Both the fixed gear 56 and the drive gear link 52 include arcuate gear sectors 64, 66 respectively that are enmeshed with one another. The distal end 68 of the drive gear link 52 is curved and, in addition to being connected to the distal end 50 of the movable link 46 by the rivet 54, the distal end 68 of the drive gear link 52 is also connected to the proximal end 70 of the connecting link 72 at the rivet 74. The rivet 74 defines an axis to which the connecting link 72 is pivotal with respect to the distal end 68 of the drive gear link 52. The distal end 75 of the connecting link 72 is then connected to a tie bar 76 (see FIGS. 4 and 6).

It will be noted that the offset relationship between the rivets 54 and 74 makes the lock handle assembly 10 pick or jimmy resistant. Specifically, if a downward force, or a force towards the bottom end 32 of the escutcheon 18, is exerted on the tie bar 76 and connecting link 72, the downward force will cause the distal end 68 of the drive gear link 52 to be biased inwards or towards the inner side 22 of the escutcheon 18 (in other words, towards the inside of the window). This action will bias the proximal end 78 of the drive gear link 52 or the arcuate gear sector 66 away from the inner side 22 of the escutcheon towards the exterior of the window. As a result, a downward force imposed on the connecting link 72 while the assembly 10 is in the position shown in FIG. 2 or the position shown in solid lines in FIG. 4 results in a biasing of the drive gear link 52, and therefore the entire assembly 10, into the locked position. Thus, the downward force imposed by a perspective intruder while the lock assembly 10 is in the locked position shown in FIG. 2 and in solid line in FIG. 4 will only further bias the lock assembly 10 in the locked position. Thus, the lock handle assembly 10 of the present invention is pick or jimmy resistant.

Turning to FIG. 4, movement of the lock handle assembly 10 from the lock to open position is illustrated. The working elements shown in solid line illustrates the lock handle assembly 10 in the locked position. As the handle 20 is rotated from the bottom end 32 of the escutcheon 18, or adjacent to the bottom wall 34, rotation from the handle 20 is transmitted to the movable link 46 by way of the shaft 40. The distal end 50 of the movable link 46, which is connected to the distal end 68 of the drive gear link 52 pulls the drive gear link 52 in an arcuate motion to the right in FIG. 4 resulting in the arcuate gear sector 66 of the drive gear link rolling along the arcuate gear sector 64 of the fixed gear 56 until the drive gear link 52 and movable link 46 reach the position shown in phantom at the right in FIG. 4. Because the connecting link 72 is connected to the distal end 68 of the drive gear link 52, the connecting link 72 and tie bar 76 are pulled downward to the position shown in phantom in FIG. 4.

It will be noted that the fixed gear 56 need not be attached or fastened to the escutcheon 18. As shown in FIG. 4, the fixed gear 56 includes an upper plate member 80 that is disposed in a slot formed by the walls 60, 62 of the outer side 24 of the escutcheon 18. Other means for attaching the fixed gear 56 to the escutcheon 18 will be apparent to those skilled in the art.

Figure 7:
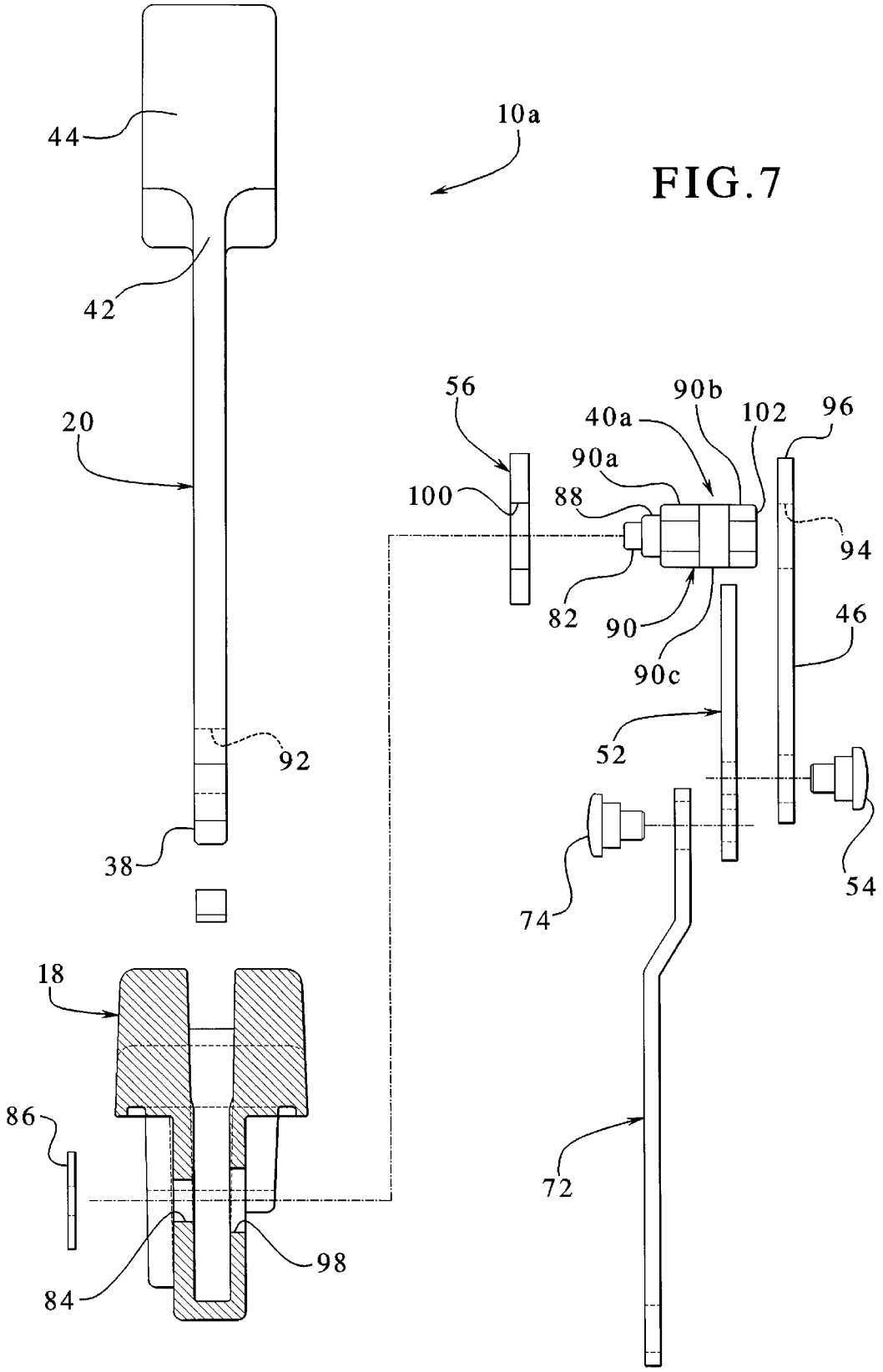
FIG. 7 is an exploded view of the embodiment illustrated in FIG. 5.

FIGS. 5 and 7 illustrate an alternative embodiment 10*a* of the present invention. Specifically, the shaft 40*a* includes a stepped configuration as opposed to the uniform star-shaped cross section of the shaft 40 shown in FIGS. 2–4. The small end section 82 passes through the hole 84 in the escutcheon 18 and a washer 86 is received over the end 82. The mid-sized stepped portion 88 is accommodated in the hole 84. The washer 86 is secured to the end 82 of the shaft 40*a* by deforming the end 82 by spinning, peening, pressing or expanding.

The larger section 90 includes at least two star-shaped sections 90*a* and 90*b*. The star-shaped section 90*a* is accommodated in the hole 92 in the distal end 38 of the handle 20. The star-shaped section 90*b* is accommodated in the hole 94 disposed in the proximate end 96 of the movable link 46. The smooth section 90*c* is accommodated in the hole 98 in the escutcheon opposite the hole 84 and in the hole 100 passing through the fixed gear 56. The end 102 of the shaft 40*a* is secured to the proximate end 96 of the movable link 46 by a deformation process such as spinning, peening, pressing or expanding.

Referring back to FIG. 4, by disposing the shaft 40 (below the inside surface of the window) and further by employing the gear segments 64, 66 of the fixed gear 56 and drive gear link 66, the present invention transforms less than 160° of handle rotation into about 160° of rotation of the connecting link axis or rivet 74. As a result, in a low profile handle and escutcheon assembly, a limited amount of rotation to the handle 20 results in adequate rotation of the connecting link 72 and therefore linear movement of the tie bar 76. In a preferred embodiment, about 120° of rotation of the handle 20 results in 160° of rotation of the rivet 74 and about 1.94" of linear movement of the tie bar 76. Further, the offset relationship with respect to the connection of the connecting link 72 to the drive gear link 52 and the connection of the movable link 46 to the drive gear link 52 renders the lock handle assembly 10 of the present invention tamper or jimmy resistant.

From the above description it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A lock handle assembly for a multi-point casement window having a frame with an inside surface, the lock handle assembly comprising:

an escutcheon for mounting to the inside surface of the frame, the escutcheon comprising an elongated body comprising an inner side facing away from the inside surface of the frame and an outer side that extends through the inside surface of the frame, the escutcheon further comprising an elongated slot for receiving a handle through the inner side of the escutcheon, the slot comprising an upper end and a lower end defined by upper and lower walls respectively, the escutcheon further comprising an exterior surface, the handle being pivotally connected to the escutcheon by a shaft having an axis that extends transversely through the slot, the shaft further connecting a movable link to the handle, the shaft also passing through a fixed gear plate, the fixed gear plate comprising an arcuate gear segment, the movable link comprising a proximal end pivotally connected to the shaft and a distal end pivotally connected to a drive gear link, the drive gear link comprising a distal end pivotally connected to the movable link and a proximate end comprising an arcuate gear segment in mesh with the arcuate gear segment of the fixed gear plate, the distal end of the drive gear link also being pivotally connected to a connecting link at a connecting axis, the upper and lower walls and axis of the shaft defining a range of rotation for the handle ranging from about 100° to about 140°, the connecting axis rotating through an arcuate path defined by an angle ranging from greater than 140° to less than 180° as the handle is rotated from engagement with the upper wall to engagement with the lower wall.

2. The lock handle assembly of claim 1 wherein the fixed gear is attached to the exterior surface of the escutcheon.

3. The lock handle assembly of claim 1 wherein the fixed gear is disposed between the movable link and the exterior surface of the escutcheon.

4. The lock handle assembly of claim 1 wherein the range of rotation for the handle ranges from about 110° to about 130°.

5. The lock handle assembly of claim 1 wherein the angle defining the arcuate path through which the connecting axis rotates ranges from about 150° to about 170°.

6. The lock handle assembly of claim 1 wherein the fixed gear plate is attached to the escutcheon.

7. The lock handle assembly of claim 1 wherein the fixed gear plate is an integral part of the escutcheon.

8. The lock handle assembly of claim 1 wherein the arcuate gear of the fixed gear extends arcuately around the shaft and is directed towards the outer side of the escutcheon.

9. The lock handle assembly of claim 1 wherein the arcuate gear of the drive gear link is directed towards the inner side of the escutcheon.

10. The lock handle assembly of claim 1 wherein the shaft passes through the outer side of the escutcheon.

11. The lock handle assembly of claim 1 wherein the shaft is disposed exterior to the inside surface of the frame.

12. The lock handle assembly of claim 1 wherein the connecting axis moves from a first point where the handle engages the upper wall to a second point where the handle engages the lower wall, the first and second points being spaced apart by a distance that is at least 1.50".

13. The lock handle assembly of claim 1 wherein the connecting axis moves from a first point where the handle engages the upper wall to a second point where the handle engages the lower wall, the first and second points being spaced apart by a distance that is about 1.89".

14. The lock handle assembly of claim 1 wherein the distal end of the drive gear link is curved and the movable link is connected to the distal end of the drive gear link at a point offset from the connecting axis.

15. The lock handle assembly of claim 1 wherein the upper and lower walls extend towards each other as they extend from the inner side towards the outer side of the escutcheon.

16. A lock handle assembly for a casement window having a frame with an inside surface, the lock handle assembly comprising:

an escutcheon for mounting to the inside surface of the frame, the escutcheon comprising an elongated body comprising an inner side facing away from the inside surface of the frame and an outer side that extends through the inside surface of the frame, the escutcheon further comprising an elongated pocket for receiving a handle through the inner side of the escutcheon, the pocket comprising an upper wall and a lower wall, the upper and lower walls extend towards each other as they extend from the inner side towards the outer side of the escutcheon, the escutcheon further comprising an exterior surface, the handle being pivotally connected to the escutcheon by a shaft having an axis that extends transversely through the slot and through the outer side of the escutcheon, the shaft further connecting a movable link to the handle, the shaft also passing through a fixed gear plate which is secured to the exterior surface of the escutcheon, the fixed gear plate comprising an arcuate gear segment, the movable link comprising a proximal end pivotally connected to the shaft and a distal end pivotally connected to a drive gear link, the drive gear link comprising a distal end pivotally connected to the movable link and a proximate end comprising an arcuate gear segment in mesh with the arcuate gear segment of the fixed gear plate, the distal end of the drive gear link also being pivotally connected to a connecting link at a connecting axis, the fixed gear plate and drive gear link being arranged coplanar with each other and between the movable link and the exterior surface of the escutcheon, the arcuate gear segment of the fixed gear plate extending arcuately around the shaft and being directed towards the outer side of the escutcheon while the arcuate gear segment of the drive gear link is directed towards the inner side of the escutcheon, the upper and lower walls and axis of the shaft defining a range of rotation for the handle ranging from about 100° to about 140°, the connecting axis rotating through an arcuate path defined by an angle ranging from greater than 140° to less than 180° as the handle is rotated from engagement with the upper wall to engagement with the lower wall.

17. The lock handle assembly of claim 16 wherein the range of rotation for the handle is about 120°.

18. The lock handle assembly of claim 17 wherein the angle defining the arcuate path through which the connecting axis rotates is about 160°.

19. The lock handle assembly of claim 16 wherein the connecting axis moves from a first point where the handle engages the upper wall to a second point where the handle engages the lower wall, the first and second points being spaced apart by a distance that is about 1.94".

20. The lock handle assembly of claim 16 wherein the distal end of the drive gear link is curved and the movable link is connected to the distal end of the drive gear link at a point offset from the connecting axis.

* * * * *